US005345973A

United States Patent [19]

Vinciguerra

[11] Patent Number: 5,345,973

[45] Date of Patent: Sep. 13, 1994

[54] ADJUSTABLE CONNECTION LINK BETWEEN THE DOBBY AND THE CRANK LEVERS OF THE HEDDLE FRAME CONTROL RODS IN A LOOM

[75] Inventor: Costantino Vinciguerra, Florence, Italy

[73] Assignee: Nuovopignone-Industrie Meccaniche e Foneria SpA, Florence, Italy

[21] Appl. No.: 72,744

[22] Filed: Jun. 7, 1993

[30] Foreign Application Priority Data

Jun. 11, 1992 [IT] Italy ..... MI 92/A/001434

[51] Int. Cl.[5] ..... D03C 1/00; D03C 9/00

[52] U.S. Cl. ..... 139/57; 403/106; 403/393; 139/66 R; 139/91

[58] Field of Search ..... 403/106, 104, 388, 393; 139/57, 58, 88, 91, 66 R, 82

[56] References Cited

U.S. PATENT DOCUMENTS

| | | | |
|---|---|---|---|
| 3,318,099 | 5/1967 | Sugden | 403/393 X |
| 4,369,815 | 1/1983 | Gehring et al. | 139/57 |
| 4,687,029 | 8/1987 | Takada | 139/88 X |

FOREIGN PATENT DOCUMENTS

| | | | |
|---|---|---|---|
| 3017629 | 11/1981 | Fed. Rep. of Germany . | |
| 2299431 | 4/1981 | France . | |
| 2504160 | 4/1981 | France . | |
| 2067607 | 1/1981 | United Kingdom . | |
| 2143000 | 1/1985 | United Kingdom | 403/393 |

*Primary Examiner*—Andrew M. Falik

*Attorney, Agent, or Firm*—Morgan & Finnegan

[57] ABSTRACT

An adjustable connection link is provided between the dobby and the first crank lever of the control rods of each loom heddle frame. The connection link consists of two tubular bars of hollow aluminum alloy section pieces, preferably of rectangular cross-section. There is at least one internal rib that is perpendicular to the major sides of the rectangle. The section pieces, moreover, are cut away along opposing sides at their adjacent ends in order to expose the corresponding parts of their internal ribs. These are kept pressed, one against the other, in an adjustable position by a bolt. The bolt is threaded into one end of the section piece and passes through a slotted hole in the corresponding end of the other section piece.

4 Claims, 3 Drawing Sheets

ADJUSTABLE CONNECTION LINK BETWEEN THE DOBBY AND THE CRANK LEVERS OF THE HEDDLE FRAME CONTROL RODS IN A LOOM

BACKGROUND OF THE INVENTION

1. Field of the Invention

This invention relates to a new connection link which, being considerably lighter than usual links without loss of strength and hence with a reduced inertial mass in play, is particularly suitable for application to modern high-speed looms.

2. Description of the Prior Art

As is well known, the dobby commands are transmitted to the first crank lever of the control rods of each loom heddle frame by a length-adjustable connection link.

Currently, the impelling requirement in looms, and in particular in air jet looms, for ever increasing operating speed has led to the construction of very lightweight heddle frames with extremely low inertia, however no attempt has yet been made to also lighten the relative connection links which as they undergo almost the same length of travel as the heddle frames have almost the same influence as these latter on the inertia of the system.

In the current state of the art, each length-adjustable connection link is generally in the form of two tubular bars of rectangular cross-section connected axially together by a length-adjustable connection member fixed to the adjacent ends of said tubular bars by spot welds and locked in position by pressure screws.

Said tubular bars are always of steel construction to allow easy and reliable welding of said connection member which, as it necessarily has to be solid and be inevitably inserted a certain distance into both said tubular bars, is also of a not inconsiderable weight, so that the connection link is currently heavy and considerably adds to the inertial forces which the dobby has to overcome.

The object of the present invention is to obviate said drawback by providing a length-adjustable connection link which is extremely light in weight, without this lightness detracting from its strength, the object therefore basically being to provide an aluminum connection link.

However such an aluminum link cannot be constructed in accordance with the known art because of the difficulty in welding the connection member. Again, riveting said member would not ensure a connection of long duration in that rivets inevitably loosen with time and generate slack because of the alternating forces to which the link is subjected; finally, a connection member which could be riveted or brazed, this latter being an extremely costly operation, would still be of excessive weight.

SUMMARY OF THE INVENTION

The problem is substantially solved according to the invention in that the length-adjustable connection link is formed from two tubular bars arranged so that they abut axially, they each being obtained from a hollow aluminum alloy section piece of preferably rectangular cross-section with at least one internal rib perpendicular to tile major sides of the rectangle, said section pieces being cut away along one side in correspondence with their adjacent ends to expose corresponding parts of their internal ribs, which hence form joining and axial adjustment surfaces for the two said tubular bars, which are then fixed in an adjustable position by a bolt screwed into one end of one tubular bar and passing through a slotted hole in the corresponding end of the other tubular bar. In this manner there is no further need to weld any member with the result that the link can now be constructed of light aluminum alloy, and in addition the length-adjustable connection member is now represented directly by said exposed parts of the internal ribs without the need for inserted members, the length variation being achieved by simply sliding said bolt along said slotted hole.

In this manner a connection link is obtained which weighs less than one half the weight of known links.

Hence, the adjustable connection link between the dobby and the first crank lever of the control rods of each loom heddle frame, consisting of two tubular bars connected axially together in abutting arrangement by a length-adjustable connection member, is characterized according to the present invention in that said two tubular bars are each obtained from a hollow aluminum alloy section piece of preferably rectangular cross-section with at least one internal rib perpendicular to the major sides of the rectangle, said section pieces being cut away along opposing sides at their adjacent ends to expose corresponding parts of their internal ribs, which are kept pressed one against the other in an adjustable position by at least one bolt screwed into said adjacent end of one section piece and passing through a slotted hole in the corresponding adjacent end of the other section piece.

According to a preferred embodiment of the present invention, which enables links to be obtained which are stronger and more resistant to flexural and torsional stresses arising generally from vibration at high speed, said section pieces comprise two overlying internal ribs perpendicular to the major sides of the section pieces, these latter being cut away on opposing sides at their adjacent ends to successively expose two parts of their internal ribs, said successively exposed parts of said section pieces being correspondingly pressed one against the other in an adjustable position by said bolt.

In order to increase the coefficient of friction between said exposed rib parts pressed together and to consequently reduce the force required from said clamping bolt and to reliably protect against any deleterious relative rotation between the two section pieces about the bolt axis, according to a further preferred embodiment of the present invention said exposed rib parts are provided with toothing or knurling.

Finally, according to a further preferred embodiment of the present invention, in each of said section pieces there is provided a longitudinal lightening aperture which removes or reduces the ribs in the region not involved in the connection. The invention is described in detail hereinafter with reference to the accompanying drawings which illustrate preferred embodiments given by way of non-limiting example only, in that technical or constructional modifications can be made thereto without leaving the scope of the present invention.

Figure 1:
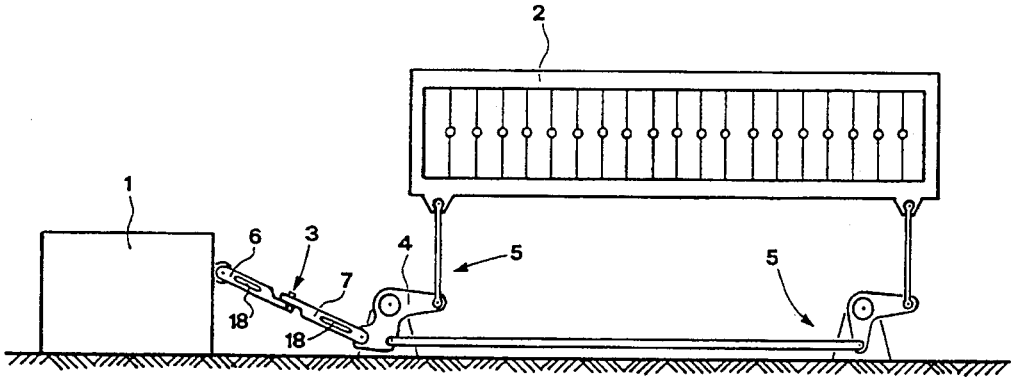
FIG. 1 is a schematic side view showing the connection between a dobby and heddle frame of a loom using a link in accordance with the invention.
Figure 2:
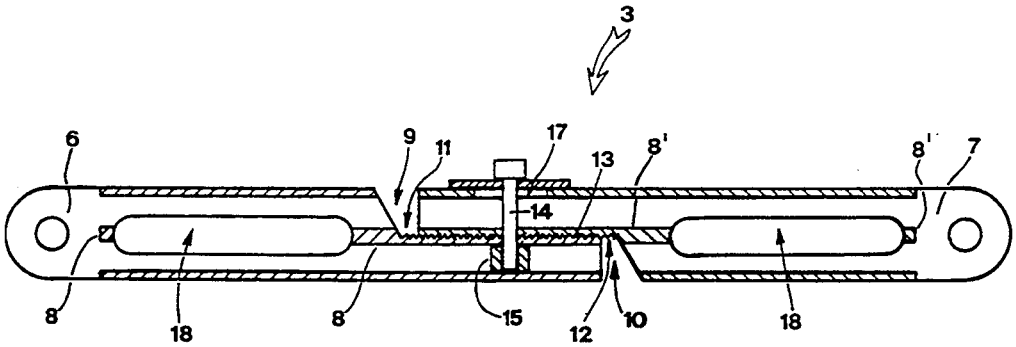
FIG. 2 is a side sectional view to an enlarged scale showing the link of FIG. 1.

In the figures the reference numeral 1 indicates a loom dobby which controls the loom heddle frame 2 via the adjustable connection link 3, which is pivoted to the first crank lever 4 of the control rods 5 for said heddle frame 2.

Figure 3:
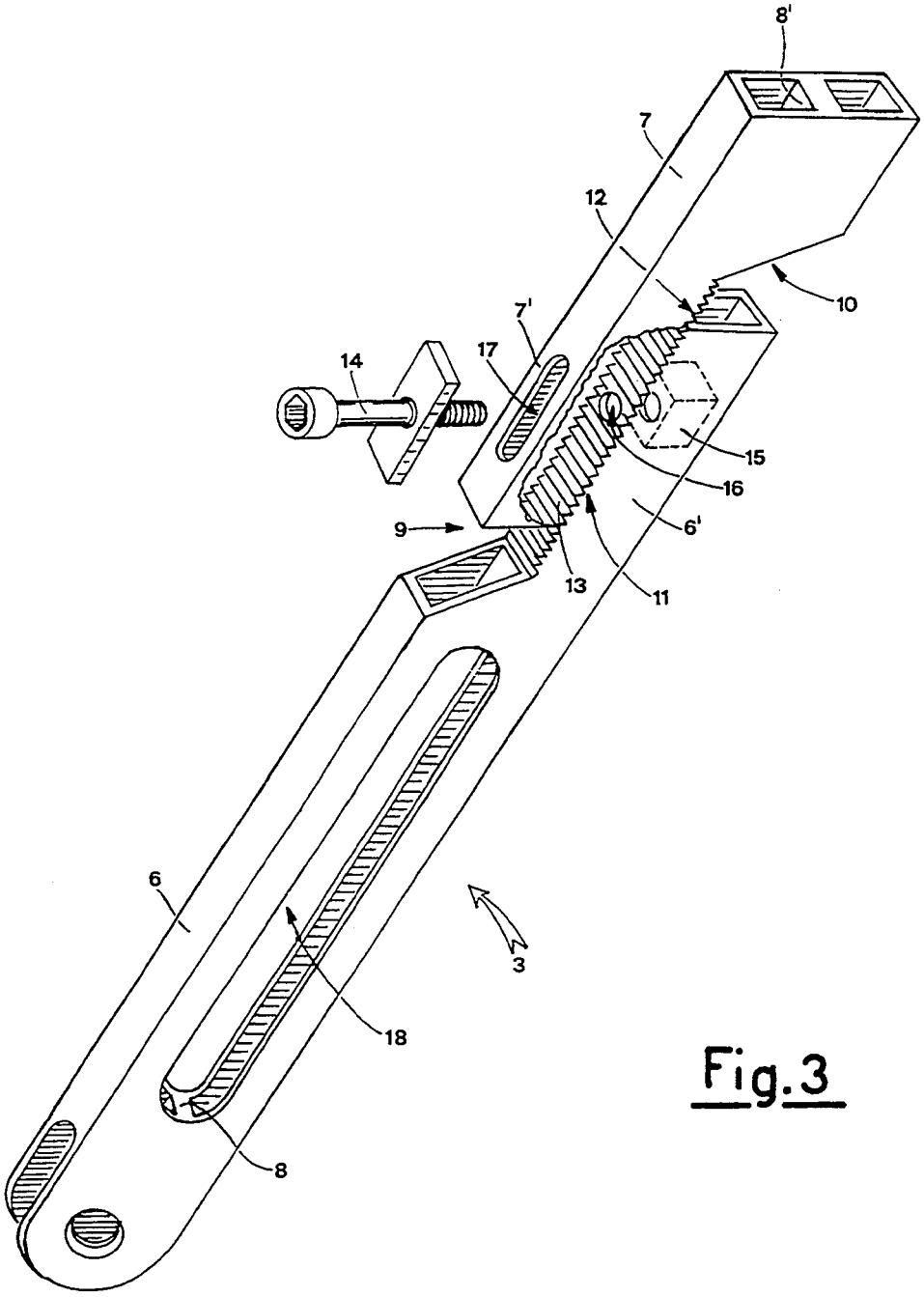
FIG. 3 is a partly sectional partial perspective view to a greatly enlarged scale showing the link of FIG. 2 with the clamping bolt not inserted.

Said link 3 consists substantially of two tubular bars 6 and 7 abuttingly connected together axially in a length-adjustable manner. More specifically, each tubular bar 6 or 7 is formed from an aluminum alloy section piece of hollow rectangular cross-section with an internal rib 8 or 8' arranged perpendicularly and fixed to the major sides of the rectangle (see specifically FIG. 3), the section piece hence being substantially in the form of a figure eight. Said two section pieces are then cut away along opposing sides at their adjacent ends 6' and 7' form cut away overlapped portions 9 and 10 respectively, to expose corresponding parts, 11 and 12 respectively, of their internal ribs 8, 8', these parts being provided with toothing or knurling 13 and being pressed together by the bolt 14 which is screwed into the block 15 rigid with the tapered end 6' of the tubular bar 6 and passes through the hole 16 in the rib 8 of the tubular bar 6 and through the slotted hole 17 in the end 7' of the other tubular bar 7. In this manner the length of the link can be adjusted by sliding the bolt 14 along the slotted hole 17.

Said two section pieces are also provided with longitudinal apertures 18 for lightening the structure.

Figure 4:
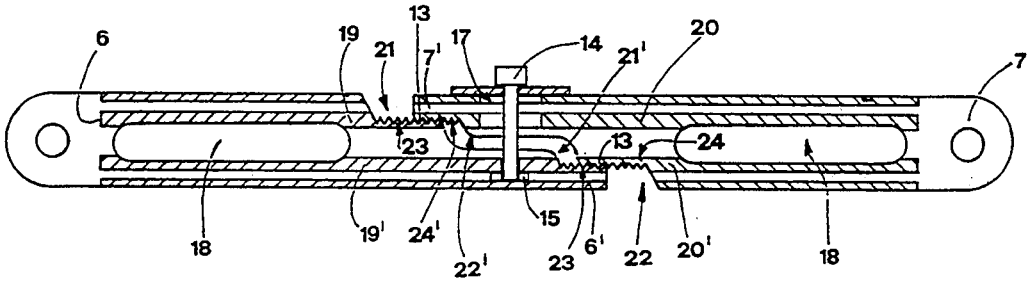
FIG. 4 is a side sectional view of another preferred embodiment of the link according to the invention.
Figure 5:
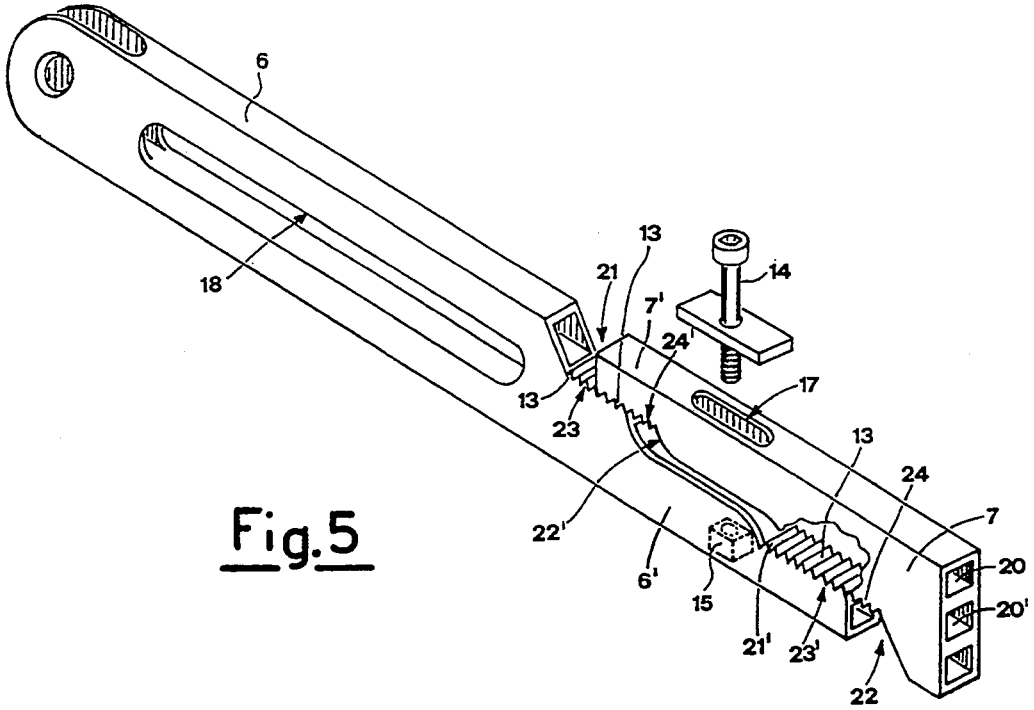
FIG. 5 is a partly sectional partial perspective view to a greatly enlarged scale showing the link of FIG. 4 with the clamping bolt not inserted.

Finally FIGS. 4 and 5 show an embodiment using two aluminum alloy section pieces 6 and 7 of hollow rectangular cross-section comprising two internal ribs 19, 19' and 20, 20' respectively, arranged perpendicular to the major sides of the rectangle. In this case the respective form cut away overlapped portions 21, 21' and 22, 22' made along opposing sides of the adjacent ends 6' and 7' of the section pieces 6 and 7 expose corresponding parts 23, 23' and 24, 24' of their internal ribs 19, 19' and 20, 20', these parts being also provided with toothing or knurling 13 and being pressed together by said bolt 14.

I claim:

1. An adjustable link for connecting a dobby to the crank lever of a control rod for a loom heddle frame, said link of comprising two tubular bars connected axially together in abutting arrangement by a length-adjustable connection member, characterized in that said two tubular bars are each a hollow aluminum alloy section piece of rectangular cross-section that has two major sides with at least one internal rib perpendicular and fixed to each of the major sides of the rectangle, said section pieces each having a cut away portion exposing a respective corresponding rib-part extending along opposing sides at their abutting adjacent ends to overlap one another in said axially connected state, at least one of said cut away portions having a slot formed therein, said cut away portions being pressed one against the other in an adjustable position by at least one bolt screwed into said cut away portion of one section piece and passing through said slotted hole in the corresponding cut away portion of the other section piece.

2. An adjustable connection link as claimed in claim 1, characterized in that said section pieces comprise two overlying internal ribs perpendicular to the major sides of the section pieces.

3. An adjustable connection link as claimed in one of the preceding claims, characterized in that said exposed rib parts are provided with toothing or knurling.

4. An adjustable connection link as recited in claim 1, characterized in that in each of said section pieces there is provided a longitudinal lightening aperture.

* * * * *